US005377572A

United States Patent [19]

Sonobe et al.

[11] Patent Number: 5,377,572

[45] Date of Patent: Jan. 3, 1995

[54] CUTTING DEVICE

[75] Inventors: Katsuyoshi Sonobe, Nagoya; Morikazu Iwase, Toyohashi, both of Japan

[73] Assignee: Brother Kogyo Kabushiki Kaisha, Nagoya, Japan

[21] Appl. No.: 44,712

[22] Filed: Apr. 12, 1993

[30] Foreign Application Priority Data

Apr. 16, 1992 [JP] Japan ..... 4-024394[U]

[51] Int. Cl.[6] ..... B26D 1/38

[52] U.S. Cl. ..... 83/583; 83/611

[58] Field of Search ..... 83/582, 583, 610, 611, 83/673, 694, 341, 349; 76/115; 30/350

[56] References Cited

U.S. PATENT DOCUMENTS

| | | | |
|---|---|---|---|
| 1,354,439 | 9/1920 | McCormick | 83/661 |
| 2,125,939 | 8/1938 | Macfarren | 83/341 |
| 3,799,020 | 3/1974 | Hoelmer | 83/349 |
| 3,855,891 | 12/1974 | Young | 83/582 |
| 3,918,339 | 11/1975 | Cailloux | 83/611 |
| 4,319,507 | 3/1982 | Kondo et al. | 83/694 |
| 4,667,554 | 5/1987 | Peery | 83/583 |
| 5,000,069 | 3/1991 | Knobel | 83/341 X |

*Primary Examiner*—Eugenia Jones

*Attorney, Agent, or Firm*—Oliff & Berridge

[57] ABSTRACT

A cutting device includes a moving blade unit rotatable around a rotating shaft and inclined at a predetermined angle against a sheet feeding surface, a receiving blade unit which is movable in a direction towards the moving blade, and an elastic member for biasing a cutting edge of the receiving blade towards a cutting edge of the moving blade. Both cutting edges of the moving blade and the receiving blade are formed with a plastically deformed portion formed by press cutting. By ensuring that each second shear droop region formed in the plastically deformed portion of each cutting edge contacts the other second shear droop region of the other cutting edge, a roll-type paper inserted between the cutting edges can be easily cut.

10 Claims, 7 Drawing Sheets

CUTTING DEVICE

BACKGROUND OF THE INVENTION

1. Field of the Invention

The present invention relates to a cutting device for cutting a lengthy material, such as heat-sensitive, roll-type paper and photosensitive roll-type paper, to a desired length. Such paper is often used in business machines such as a facsimile device or a printer.

2. Description of Related Art

As shown in U.S. Pat. No. 3,918,339 to Cailloux, a conventional cutting device comprises a movable blade having a rectilinear cutting edge, which is rotated around a rotatable shaft and inclined at a predetermined angle to a surface of a sheet to be fed, and a stationary blade having a rectilinear cutting edge and provided substantially parallel to the surface of the sheet to be fed. When the movable blade is rotated around its shaft, the point where the movable blade contacts the stationary blade moves laterally from the cutting start position to the cutting end position. Thus, a roll-type paper inserted between the movable blade and the stationary blade is cut to a desired length.

Also, another conventional cutting device comprises a movable blade having a rectilinear cutting edge, a receiving blade having a rectilinear cutting edge and pivotably provided around a rotatable shaft and a spring for biasing the receiving blade towards the movable blade. The receiving blade rotatable shaft is substantially parallel to the surface of the sheet. Thus, any undesirable warp or curve resulting from the manufacturing process of the blades is compensated for.

In the above conventional cutting devices, if enough cutting power is provided to the device, any material can be surely cut in spite of the shape of the cutting edge. However, the cutting power (drive torque) available to the cutting device is limited. Therefore, in actual cutting devices, a cutting step during the manufacturing process of the blades, such as a milling cutting, is performed on the cutting edges of both the movable blade and the receiving blade, or to either one of the blades. Thus, one or both edges are sharpened and the contacting area of the edges and the paper inserted therein is reduced. Thereby, the cutting power generated when the paper is cut is enlarged, and the drive torque necessary for such cutting is reduced.

If the cutting step is performed to the cutting edges of both blades, it is necessary to repeat the sheet cutting movement several times without inserting the sheet between the cutting blades, after the blades are assembled as a cutting device. Thereby, a fragile part of each cutting edge which is formed during the cutting step is removed and the cutting edges fit together smoothly. As a result, a smooth cutting movement can be obtained.

However, in the cutting device having such the movable blade and the receiving blade, as mentioned above, it is necessary to perform the cutting step for the manufactured blade, and further the running-in step in which the sheet cutting movement is repeated several times without inserting the paper between the cutting blades. Therefore, the manufacturing cost of the cutting blade is high, and the manufacturing process is complicated and wastes much time.

SUMMARY OF THE INVENTION

It is therefore an object of the present invention to provide a cheap cutting device for which the manufacturing process of a moving blade and a receiving blade can be simplified, and which can omit the running-in process after assembling the blades.

In order to achieve this object, a cutting device of the present invention comprises a moving blade unit having a cutting edge constructed with a plastically deformed portion formed by press cutting and is rotatably provided around a predetermined axis, a receiving blade unit having a cutting edge constructed with a plastically deformed portion formed by press cutting and is provided movably in the direction where the cutting edge of the receiving blade unit comes into contact with the cutting edge of the moving blade unit, arid an elastic member for firmly biasing the cutting edge of the receiving blade unit against the cutting edge of the moving blade unit.

Besides, from the cutting start position to cutting end position, the cutting edges of the above-mentioned moving blade unit and the receiving blade unit mutually contact each other at a boundary portion which is between the shearing side region and the shear droop region formed by the press cutting step.

In the cutting device of the present invention thus constructed, the cutting edges of the moving blade unit and the receiving blade unit which are constructed with the plastically deformed portions formed by press cutting are biased by the elastic member, and firmly contact each other. Under such conditions, the moving blade unit is rotated around the predetermined axis, and the contact point of the moving blade unit and the receiving blade unit moves laterally between the cutting start position and cutting end position. Thus, the lengthy material inserted between the blades is cut.

As mentioned above, the cutting edges of both the moving blade and the receiving blade of the cutting device of the present invention are constructed with plastically deformed portions, which are formed by the press cutting step, and both cutting edges are arranged to mutually contact, from the cutting start position to the cutting position end, at a cutting portion. The cross section of the cutting portion has radius of curvature of about 0.03–0.05 millimeters, which is formed at the boundary portion located between the shearing side region and the shear droop region formed by the press cutting step. According to the cutting device of the present invention, there is no need to perform the cutting step, such as milling cutting, and the running-in step after assembly of the blades can be omitted. Therefore, a very cheap cutting device whose manufacturing process is very simple can be obtained.

BRIEF DESCRIPTION OF THE DRAWINGS

The preferred embodiment of the present invention will be described in detail with reference to the following figures wherein.

DETAILED DESCRIPTION OF THE PREFERRED EMBODIMENT

Figure 1:
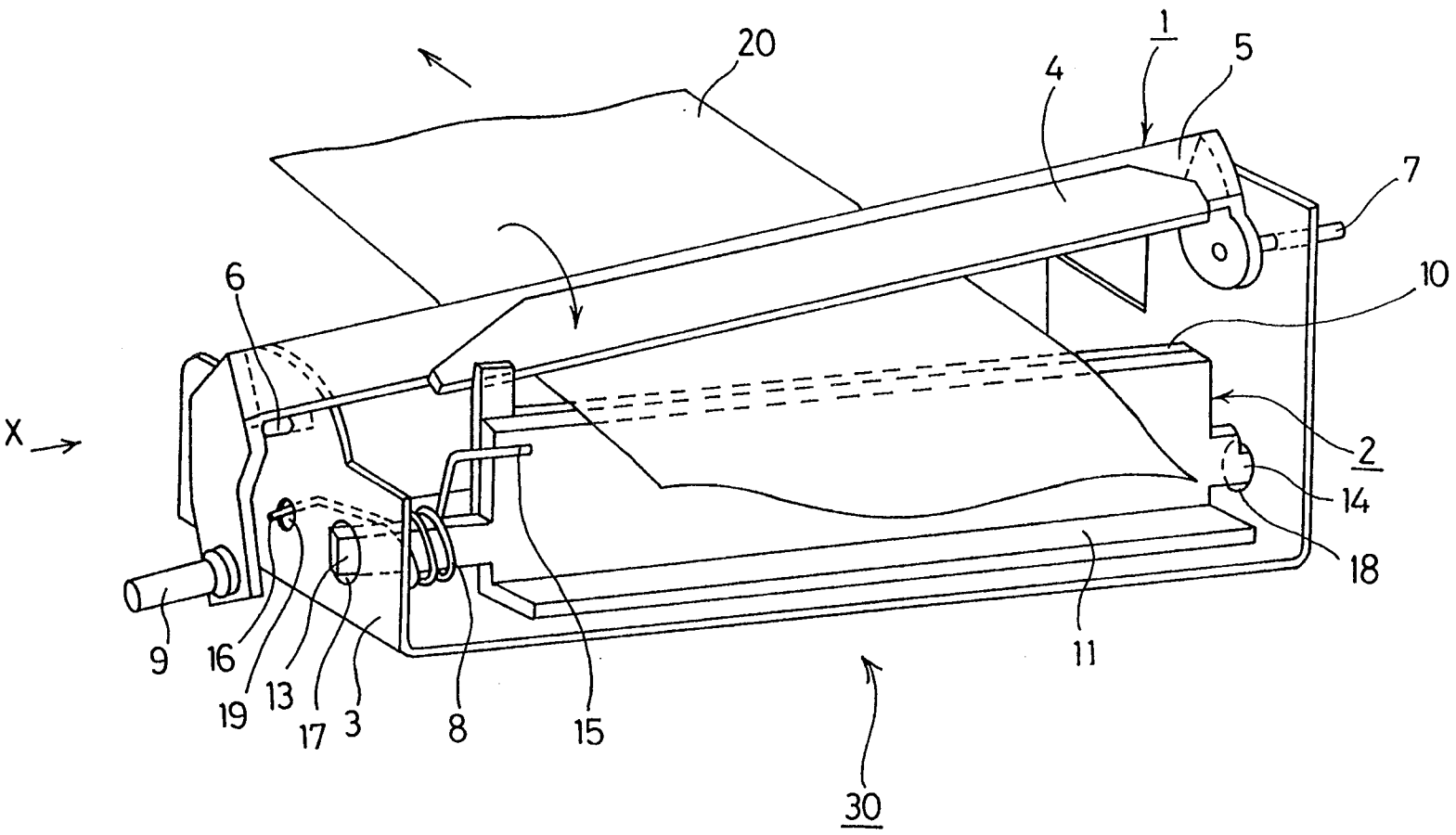
FIG. 1 is a schematic perspective view of a cutting device according to present invention.
Figure 2:
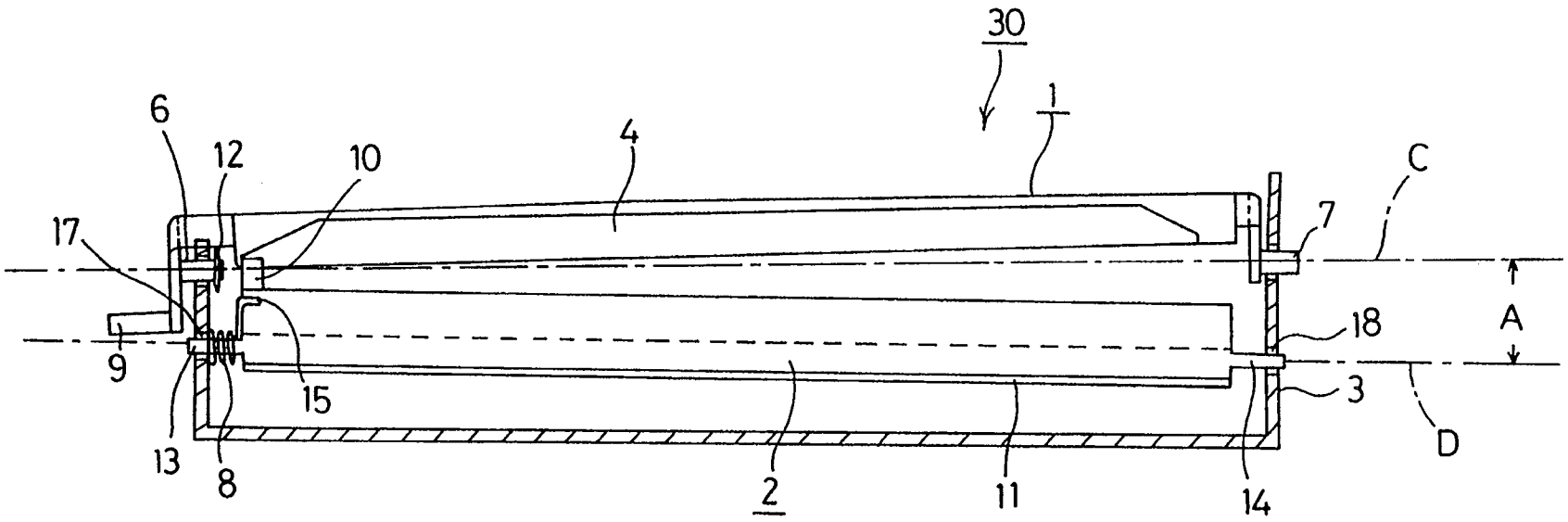
FIG. 2 is a schematic elevational view of the cutting device shown in FIG. 1, showing a part of a cutter frame 3 as a sectional view.
Figure 3:
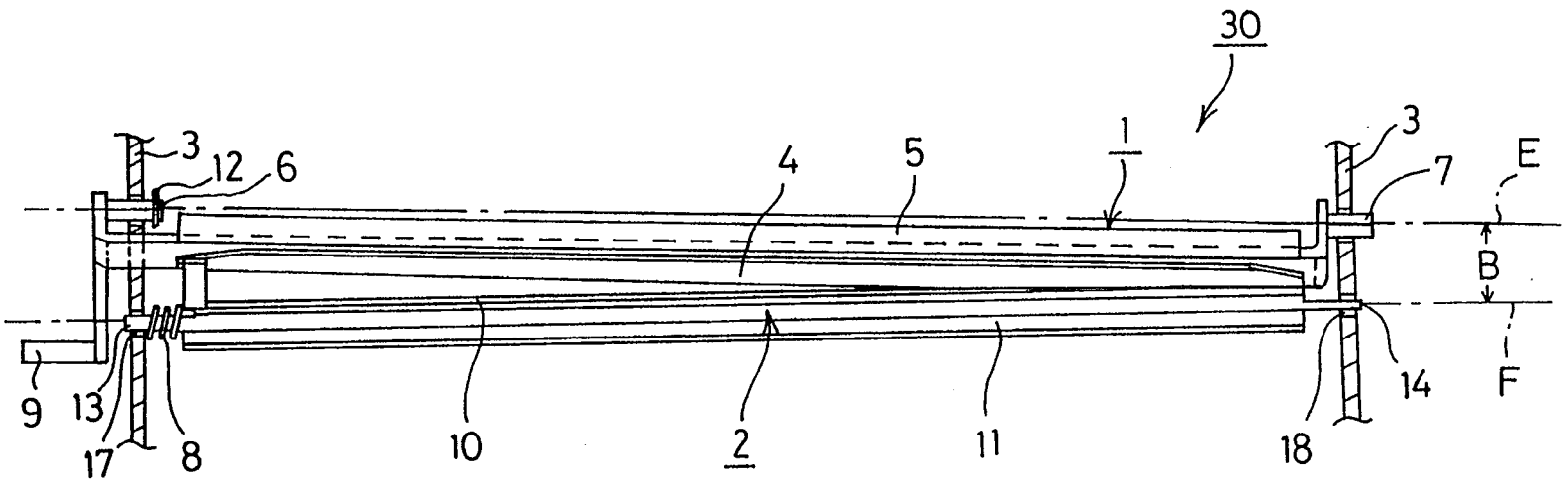
FIG. 3 is a schematic upper plan view of the cutting device shown in FIG. 1, showing a part of a cutter frame 3 as a sectional view.

Referring now to the drawings, the preferred embodiments of the present invention will be described. As shown in FIGS. 1–3, the cutting device 30 of the present invention includes an upper blade unit 1 as a moving blade unit, a lower blade unit 2 as a receiving blade unit, a cutter frame 3 which supports the upper blade unit 1 and the lower blade unit 2, and a torsion spring 8 (which is an elastic member) biasing the lower blade unit 2 so as to always contact the upper blade unit 1. The upper blade unit 1 includes an upper blade 4 having a rectilinear cutting edge, an upper blade frame 5 for supporting the upper blade 4, pins 6 and 7 which form a rotatable shaft of the upper blade unit 1, and a driving shaft 9 which transmits torque to the upper blade unit 1. Each pin 6 and 7 is pivotably supported by the cutter frame 3, and on one end of the pin 6, a stopper 12 is provided for preventing removal of the upper blade unit 1 from the cutter frame 3.

The lower blade unit 2 includes a lower blade 10 having a rectilinear cutting edge for cutting some material jointly with the upper blade 4, and a lower blade frame 11 for supporting the lower blade 10. Projections 13 and 14 are provided at both ends of the lower blade frame 11 to pivotably support the lower blade unit 2 by engaging with holes 17 and 18 provided in the cutter frame 3.

Further, the projection 13 of the lower blade frame 11 is inserted axially through the coil of the torque spring 8. One hook 15 of the twist spring 8 is hooked to one side of the lower blade frame 11, and the other hook 16 is engaged in a hole 19 provided in the cutter frame 3. Thereby, the lower blade 10 is biased toward the upper blade 4.

Furthermore, as shown in FIGS. 2 and 3, the pin 7 is arranged in a position displaced vertically relative to the pin 6, and the rotatable shaft of the upper blade unit 1 is therefore inclined in the direction of the rotatable shaft of the lower blade unit 2. Therefore, the upper blade 4 comes in contact with the lower blade 10 at a single point.

This mechanism is explained in detail as follows. As shown in FIG. 2, the pin 7 is arranged at raised position from the line C horizontally extending from the pin 6, and the rotatable shaft of the upper blade unit 1 is inclined. A line D horizontally extends through pins 13 and 14. Thus, an inclination angle A (hereinafter referred to as the "shear angle") for moving the cutting point one by one is determined by the intersection of Lines C and D. Moreover, as shown in FIG. 3, the pin 7 is arranged in a position horizontally displaced to the side of the lower blade frame 11 from the line E horizontally extending from the pin 6, and the rotatable shaft of the upper blade unit 1 is inclined. A line F horizontally extends through pins 13 and 14. Thus, an intersection angle B (hereinafter referred to as "skew angle") is determined by the intersection of lines E and F.

When the upper blade unit 1 begins to rotate around the axis extending through the pin 6 and the pin 7 by the rotation power transmitted from the driving shaft 9, the upper blade 4 intersects with the lower blade 10, and the cutting edge of the upper blade 4 movingly contacts the lower blade 10 at a single point along the blades between the cutting start position and the cutting end position. Thereby, a sheet 20 inserted between the upper blade 4 and the lower blade 10 is cut.

Figure 4:
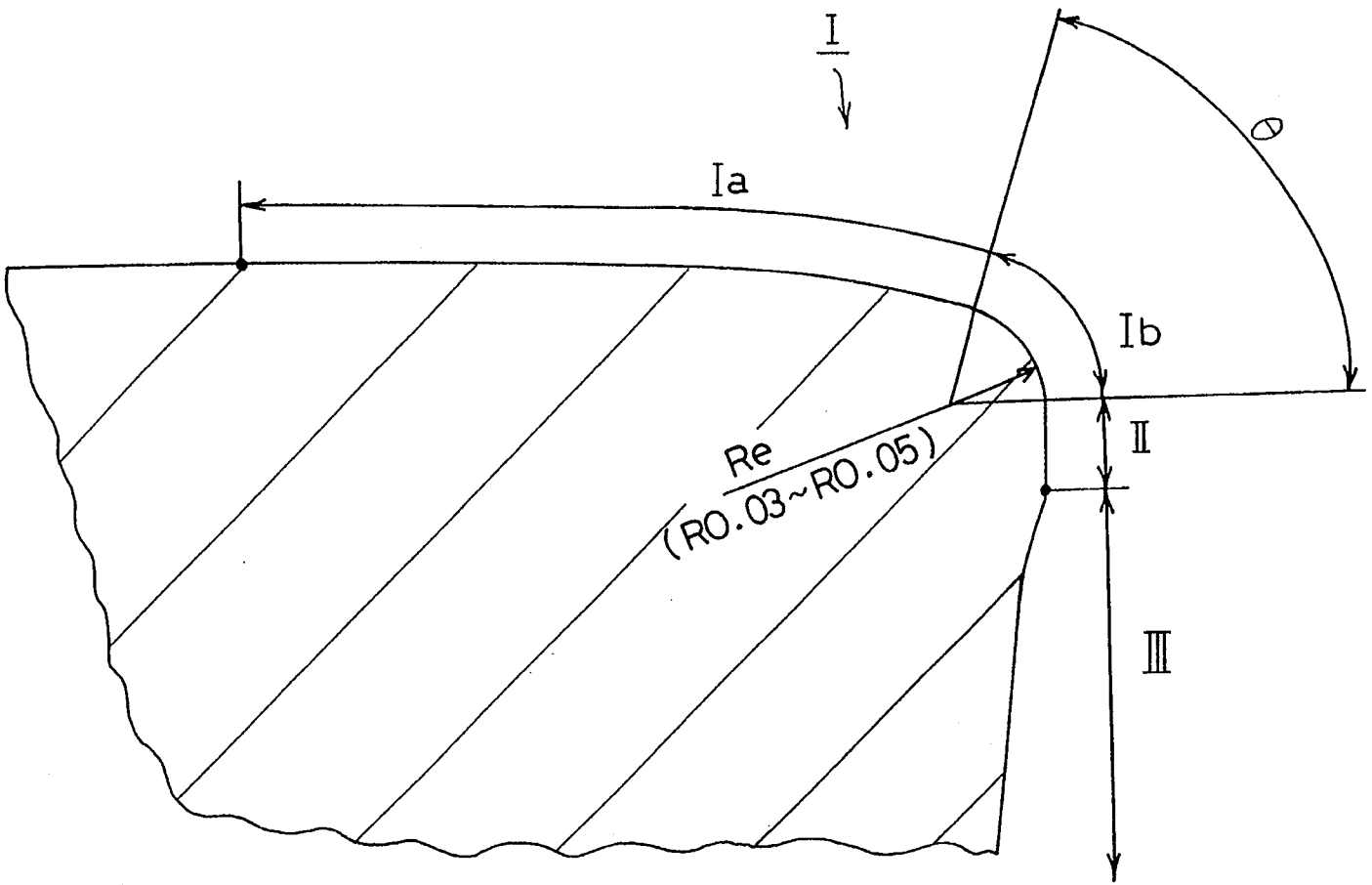
FIG. 4 is a cross-sectional view of a cutting edge made by press cutting work.

Next, a sectional shape of the cutting edge to be used in the present embodiment is explained with reference to FIG. 4.

A cutting edge manufactured by press cutting comprises the following regions: (1) a shear droop region (I) formed when a tool for press cutting digs into, a material, (2) a shearing side region (II) which receives a large shearing strain, is rubbed on a tool used in the press cutting step and is polished, (3) a breaking side region (III) where a crack is caused in the material and which has a very rough surface, and (4) a return region (IV) to be generated when the material is torn off (not shown in FIG. 4).

Further, the shear droop region (I) can be divided into two subregions: (1) a first shear droop region (Ia) which is formed by being pulled by the tool when the tool collides with the material, and (2) a second shear droop region (Ib), which is plastically deformed by a collision with the tool in the neighborhood around the collision point.

The second shear droop region (Ib) exists in the boundary part of the shear droop region (I) (the first shear droop region (Ia)) and the shearing side region (II), is a region having a very small radius of curvature, and is clearly distinguishable from the first shear droop, region (Ia), which has a large radius of curvature.

Besides, the section of the second shear droop region (Ib) is an extremely small circular arc having a radius of curvature of about 0.03–0.05 millimeters. The angle of the second shear droop region (Ib) (as shown in FIG. 4 as $\theta$) changes depending on various conditions during the press cutting step, such as the material of the blades 4 and 10, the cutting speed, and the cutting load. However, it never disappears.

Next, the positional relationship of the upper blade 4 and the lower blade 10 is explained with reference to FIGS. 5–10.

Figure 5:
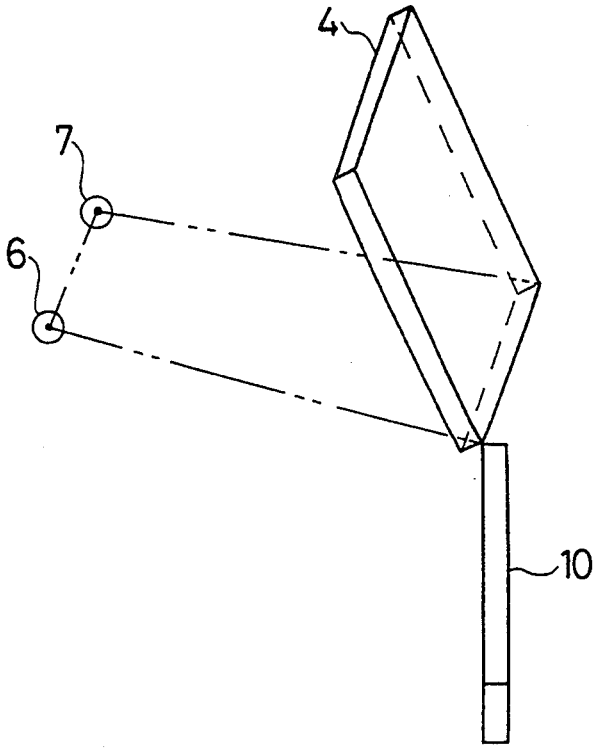
FIG. 5 shows a positional relationship between an upper blade 4 and a lower blade 10 when a cutting operation by the cutting device shown in FIG. 1 is started.
Figure 6:
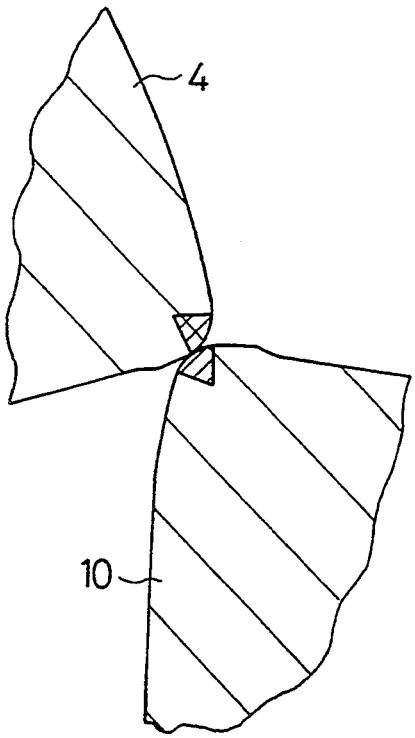
FIG. 6 is an expanded sectional view showing around a contact point of the upper blade 4 and the lower blade 10 shown in FIG. 5.

FIG. 5 shows the positional relationship among only the upper blade 4, the lower blade 10 and the pin 6 and 7 which constitute the rotatable shaft of the upper blade unit 1, when the cutting device 30 is seen from direction indicated by the arrow X (shown in FIG. 1), so that the positional relationship of the upper blade 4 and the lower blade 10 at the cutting start position of the sheet 20 is clearly shown. As a matter of convenience, only a part of the upper blade 4 which is necessary to cut the sheet 20 is described. Moreover, FIG. 6 is an expanded sectional view of the contacting portion of the upper blade 4 and the lower blade 10 shown in FIG. 5. The part where a narrower hatching is used shows the area of the second shear droop region (Ib).

Figure 7:
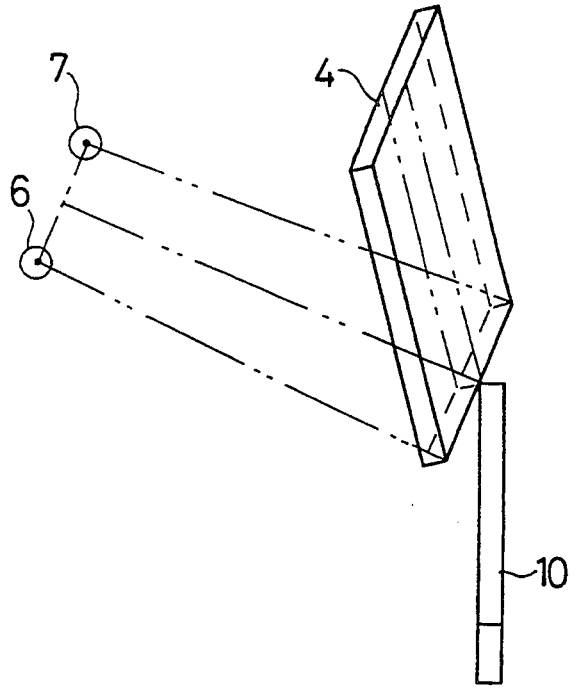
FIG. 7 is shows a positional relationship between the upper blade 4 and the lower blade 10 when a cutting operation by the cutting device shown in FIG. 1 is on a halfway.
Figure 8:
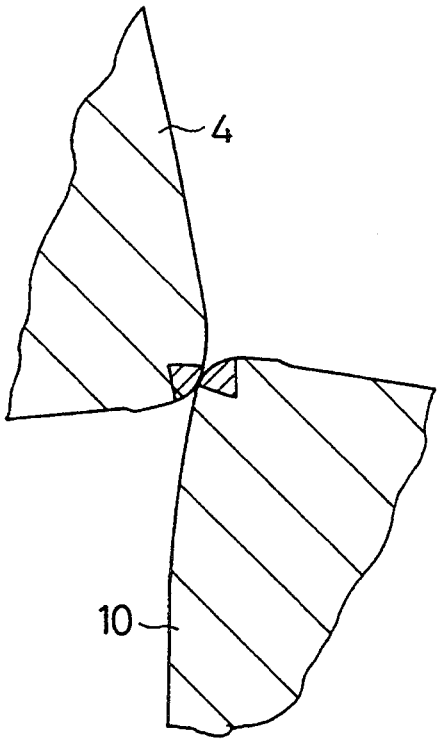
FIG. 8 is an expanded sectional view showing around a contact point of the upper blade 4 and the lower blade 10 shown in FIG. 7.

FIG. 7 shows a positional relationship at the time when the cutting process is halfway completed, so that the positional relationship of the upper blade 4 and the lower blade 10 at the center between the cutting start position and the cutting end position of the sheet 20 is clearly shown. FIG. 8 is also an expanded sectional view of the contacting portion of the upper blade 4 and the lower blade 10 shown in FIG. 7.

Figure 9:
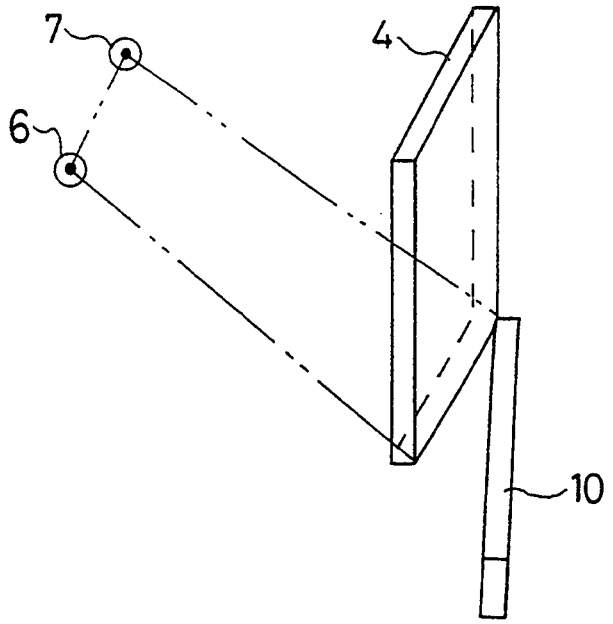
FIG. 9 is shows a positional relationship between the upper blade 4 and the lower blade 10 when a cutting operation by the cutting device shown in FIG. 1 is finished.
Figure 10:
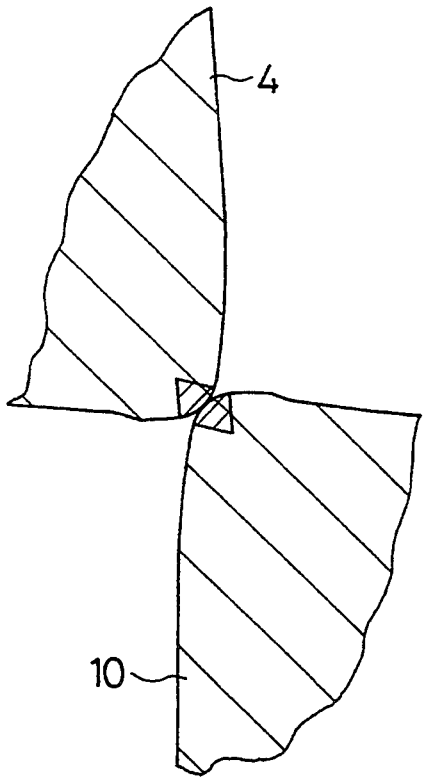
FIG. 10 is an expanded sectional view showing around a contact point of the upper blade 4 and the lower blade 10 shown in FIG. 9.

FIG. 9 shows a positional relationship at the time when the cutting is finished, so that the positional relationship of the upper blade 4 and the lower blade 10 at the cutting end position of the sheet 20 is clearly shown. FIG. 10 is also an expanded sectional view of the contacting portion of the upper blade 4 and the lower blade 10 shown in FIG. 9.

The positional relationship shown in the above drawings can variously change by the skew angle A, the shear angle B, the radius for rotation of the upper blade 4, and the positional relationship between each rotation shaft of the upper blade 4 and the lower blade 10. Therefore, if the position of the pins 6 and 7 of the upper blade unit 1 and the rotation radius thereof to the lower blade unit 2 are properly adjusted, the second shear droop region (Ib) of the upper blade 4 can contact with the second shear droop region (Ib) of the lower blade 10 at the cutting start position as shown in FIGS. 5 and 6, and at the cutting end position as shown in FIGS. 9 and 10, and also at the center between the cutting start position and the cutting end position as shown in FIGS. 7 and 8.

As mentioned above, according to the proper adjustment of the position of both cutting blades and the rotating shaft thereof, the circular arcs forming the second shear droop regions (Ib) of each cutting edge, having extremely small radii (in the range of 0.03–0.05 millimeter), always come into contact with each other from the cutting start position to the cutting end position. Therefore, the blades contact over a very small contacting area, so that the sheet 20 can be easily cut without increasing the drive torque of the drive motor, compared with the conventional cutting device which uses a ground blade.

Further, the arrangement of each blade is not limited to the arrangement disclosed in the present embodiment. Even if the position and the range of the second shear droop region (Ib) of the cutting edges are changed by the difference of the material of the blade and the press cutting method, it is possible to get similar result if both of the upper blade and the lower blade are arranged to mutually contact from the cutting start position to the cutting end position, the second shear droop regions (Ib) formed on the upper blade and the lower blade corresponding to the shape of the blade to be used.

Moreover, the torsional spring 8 as the elastic member biasing the lower blade unit 2 toward the upper blade unit 1 can be replaced with another member from which the necessary biasing force can be obtained.

What is claimed is:

1. A cutting device comprising:

a first blade unit;

a substantially flat bar forming a first blade having a cutting edge that is a plastically deformed portion along its length, said first blade mounted to said first blade unit;

a second blade unit;

a substantially flat bar forming a second blade having a cutting edge that is a plastically deformed portion along its length, said second blade mounted to said second blade unit;

supporting means for supporting said first blade unit pivotably around a predetermined axis, so that the plastically deformed portion of the cutting edge of the first blade contacts the plastically deformed portion of the cutting edge of the second blade at all cutting positions; and a driving mechanism for rotating said first blade unit around the predetermined axis, wherein a cross-section of each plastically deformed portion at each point along the entire length has a radius of curvature that is between about 0.03 and 0.05 millimeters.

2. The cutting device of claim 1, wherein the second blade unit is movably mounted on the supporting means, the second blade unit being movable toward the first blade unit.

3. The cutting device of claim 1, wherein the cutting edges of the first blade unit and the second blade unit mutually contact at the plastically deformed portions of each cutting blade, each cutting blade having a shearing side region and a shear droop region, the plastically deformed portion of each cutting blade formed between the shearing side region and the shear droop region the cutting edges contacting at the plastically deformed portions during a cutting operation.

4. The cutting device of claim 1, wherein the first blade unit and the second blade unit are biased toward each other, so that the cutting edges of the first blade unit and the second blade unit positively contact each other at all cutting positions.

5. The cutting device of claim 4, wherein one of the first blade unit and the second blade unit has an elastic member for biasing the first blade unit and the second blade unit toward each other.

6. The cutting device of claim 4, wherein the second blade unit has an elastic member, so that the cutting edge of the second blade unit is biased towards the cutting edge of the first blade unit.

7. A cutting device comprising:

a moving blade unit which is pivotable around a predetermined axis, the moving blade unit comprising:

a substantially flat blade having a cutting edge, the cutting edge having a plastically deformed boundary part along its length;

a moving blade arm supporting the blade;

a shaft for pivoting the moving blade unit; and driving means for transmitting a driving power to the moving blade unit;

a receiving blade unit movable in a contact direction toward the moving blade unit, the receiving blade unit comprising:

a substantially flat receiving blade having a cutting edge, the cutting edge having a plastically deformed boundary part along its length, the receiving blade performing a cutting operation when in contact with the blade of the moving blade unit; and a receiving blade arm supporting said receiving blade;

a cutter frame for supporting the moving blade unit and the receiving blade unit; and biasing means for biasing the cutting edge of the blade of the moving blade unit and the cutting edge of the receiving blade toward each other;

wherein the cutting edges of the blade of the moving blade unit and the receiving blade mutually contact at all cutting positions at the boundary parts of the blades, each boundary part is formed between a shearing side region and a shear droop region formed on each blade and a cross-section of each plastically deformed boundary part at each point along the entire length has a radius of curvature that is between about 0.03 and 0.05 millimeters.

8. The cutting device of claim 7, wherein a ring member for preventing removal of the moving blade unit from the cutter frame is supplied on the shaft of the moving blade unit.

9. The cutting device of claim 7, wherein the biasing means is provided on the receiving blade unit, the cutting edge of the receiving blade unit biased firmly into contact with the cutting edge of the moving blade unit by the biasing means.

10. The cutting device of claim 9, wherein the biasing means is a torsion spring.

* * * * *